US005704103A

United States Patent [19]

Crowley et al.

[11] Patent Number: 5,704,103

[45] Date of Patent: Jan. 6, 1998

[54] DISPLAY DEVICE FOR RETAINING CREMATION REMAINS

[76] Inventors: Joan A. Crowley; David A. Crowley, both of 474 NE. Redrock Ct., Port St. Lucie, Fla. 34983

[21] Appl. No.: 759,066

[22] Filed: Dec. 2, 1996

[51] Int. Cl.[6] ..... A61G 17/00

[52] U.S. Cl. ..... 27/1; 40/124.5

[58] Field of Search ..... 27/1, 2, 35; D99/5, D99/19; 312/114, 122, 117, 291; 40/124.5, 714, 715

[56] References Cited

U.S. PATENT DOCUMENTS

| | | | |
|---|---|---|---|
| 1,131,283 | 3/1915 | Stewart | 312/117 |
| 1,750,440 | 4/1930 | Tarver | 312/114 X |
| 2,917,853 | 12/1959 | Lawsky | 40/124.5 X |
| 3,028,207 | 4/1962 | Darnell | 312/122 X |
| 4,324,026 | 4/1982 | Craft | 27/1 |
| 5,127,718 | 7/1992 | Paine et al. | 312/114 |

*Primary Examiner*—Kien T. Nguyen
*Attorney, Agent, or Firm*—Michael F. Kroll

[57] ABSTRACT

A display device (10) for retaining cremation remains comprising a hollow base member (12) having a front opening (14). A drawer (16) fits within the front opening (14) of the hollow base member (12), so that the drawer can receive a bag (18) with the cremation remains. An ornament assembly (20) is on the hollow base member (12). A hollow transparent pyramid (22) fits over the ornament assembly (20) on the hollow base member (12).

27 Claims, 5 Drawing Sheets

118
22
10
116
110
106
108
100
2b
82
84
104
102
80
20
78
60
42
70
56
58
62
68
52
54
66
76
64
56
46
12
44
60
14
34
62
72
24
28
24
30
16
26
108
106
74
100
104
84
20
102
80
78

88
86
20
84
90
80
78

10
22
28
12
76
56
42
60
54
52
62
64
66
68

DISPLAY DEVICE FOR RETAINING CREMATION REMAINS

BACKGROUND OF THE INVENTION

1. Field of the Invention

The instant invention relates generally to crematory urns and more specifically it relates to a display device for retaining cremation remains.

Cremation has been practiced in Western societies since about 1000 BC, when it was first used by the Greeks. It is also an ancient practice among the Hindus of India. Such cremations were always performed in the open, as they are in India today. The waterfront of Benares, India, is lined with concrete and marble slabs on which funeral pyres, structures on which the dead are burned, are erected. After burning, the remains are cast into the Ganges River.

In modern Western cremations the body is placed into what amounts to an oven, where intense heat transforms it into a few pounds of powdery ash. The ash may be kept in an urn, buried, or scattered in some favored place. Cremation has been looked upon with disfavor by members of many religious groups, but the growing shortage of burial space in urban centers makes it a practical way of disposing of the dead.

2. Description of the Prior Art

Numerous crematory urns have been provided in prior art that are adapted to hold human remains after cremation which can appear unsightly. While these units may be suitable for the particular purpose to which they address, they would not be as suitable for the purposes of the present invention as heretofore described.

SUMMARY OF THE INVENTION

A primary object of the present invention is to provide a display device for retaining cremation remains that will overcome the shortcomings of the prior art devices.

Another object is to provide a display device for retaining cremation remains that is visually pleasing to the eye for viewing, and is a proper receptacle for a memorial of the person who died.

An additional object is to provide a display device for retaining cremation remains that utilizes a fiber optic system to light up the device and enhance its appearance when placed onto a support surface in a room of a building.

A further object is to provide a display device for retaining cremation remains that is simple and easy to use.

A still further object is to provide a display device for retaining cremation remains that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 1:
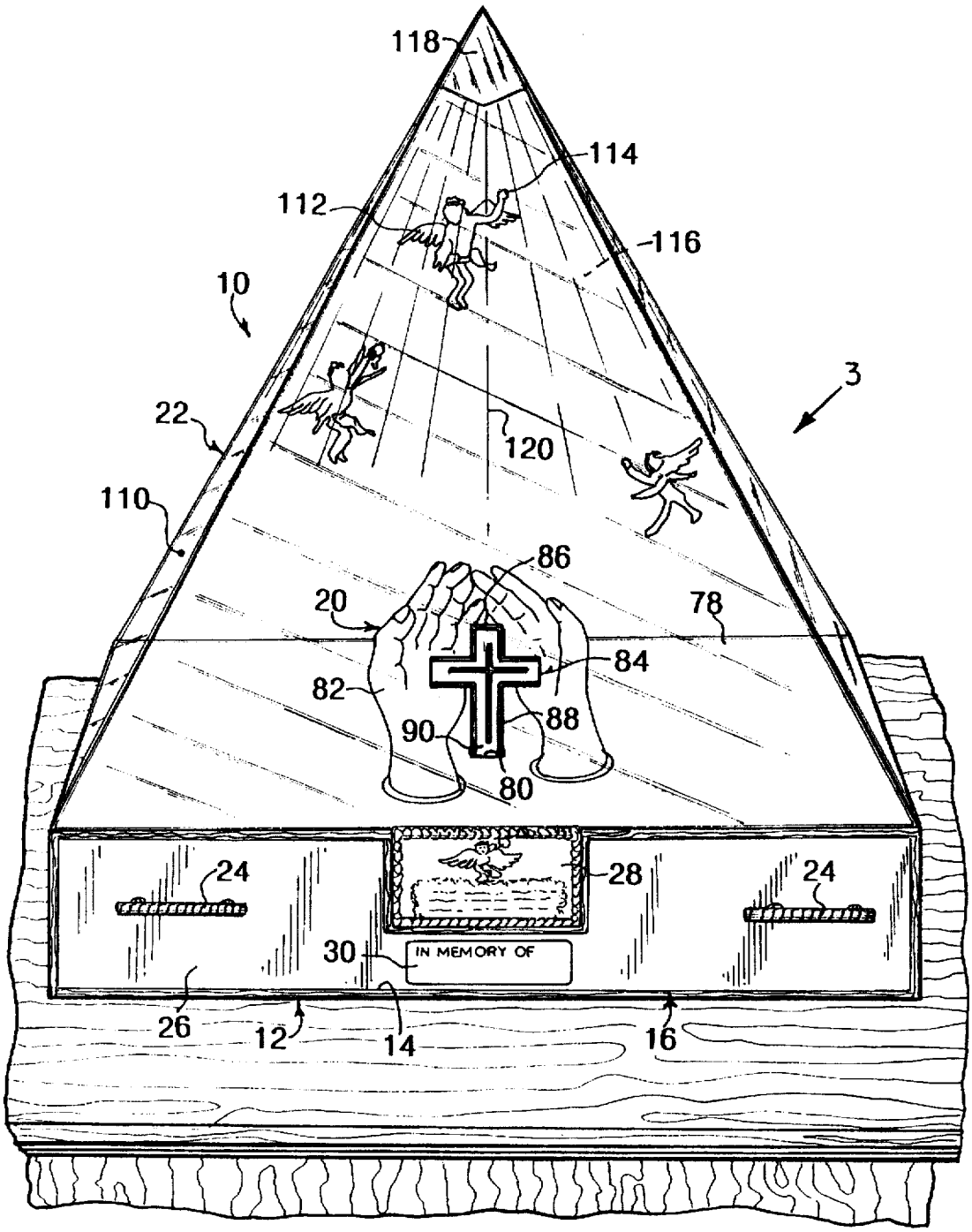
FIG. 1 is a front perspective view of the instant invention utilizing a fiber optic cross between a two cupped hands ornament.
Figures 2, 2A, 2B:
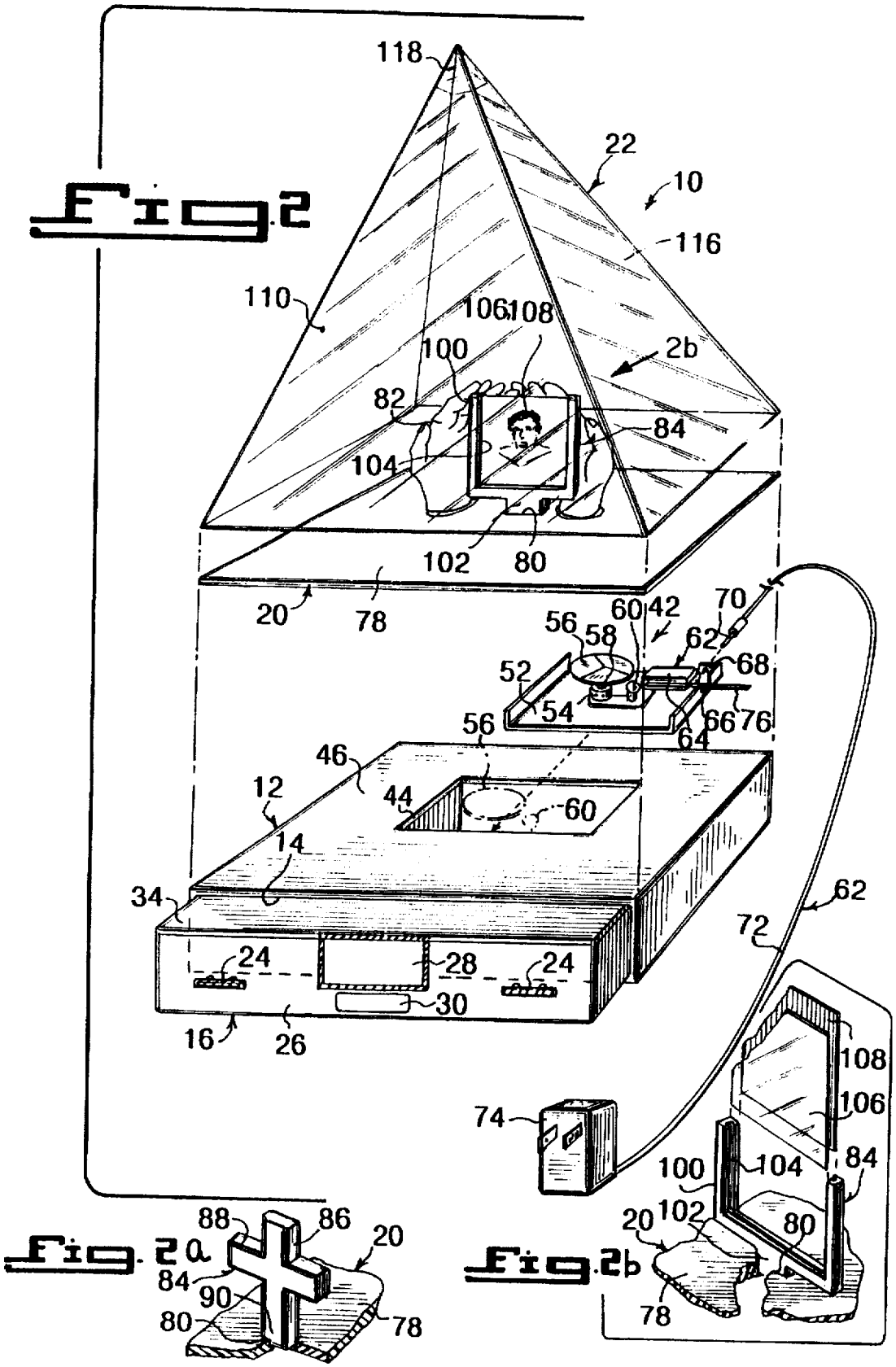
FIG. 2 is a partly exploded side perspective view of the instant invention utilizing a fiber optic picture holder between the two cupped hands ornament.

FIG. 2*a* is a perspective view taken in the direction of arrow 2*a* in FIG. 1, showing the fiber optic cross mounted in the platform which is broken away.

FIG. 2*b* is a perspective view taken in the direction of arrow 2*b* in FIG. 2, showing the fiber optic picture holder mounted in the platform which is broken away and the plastic cover and picture exploded therefrom.

Figure 3:
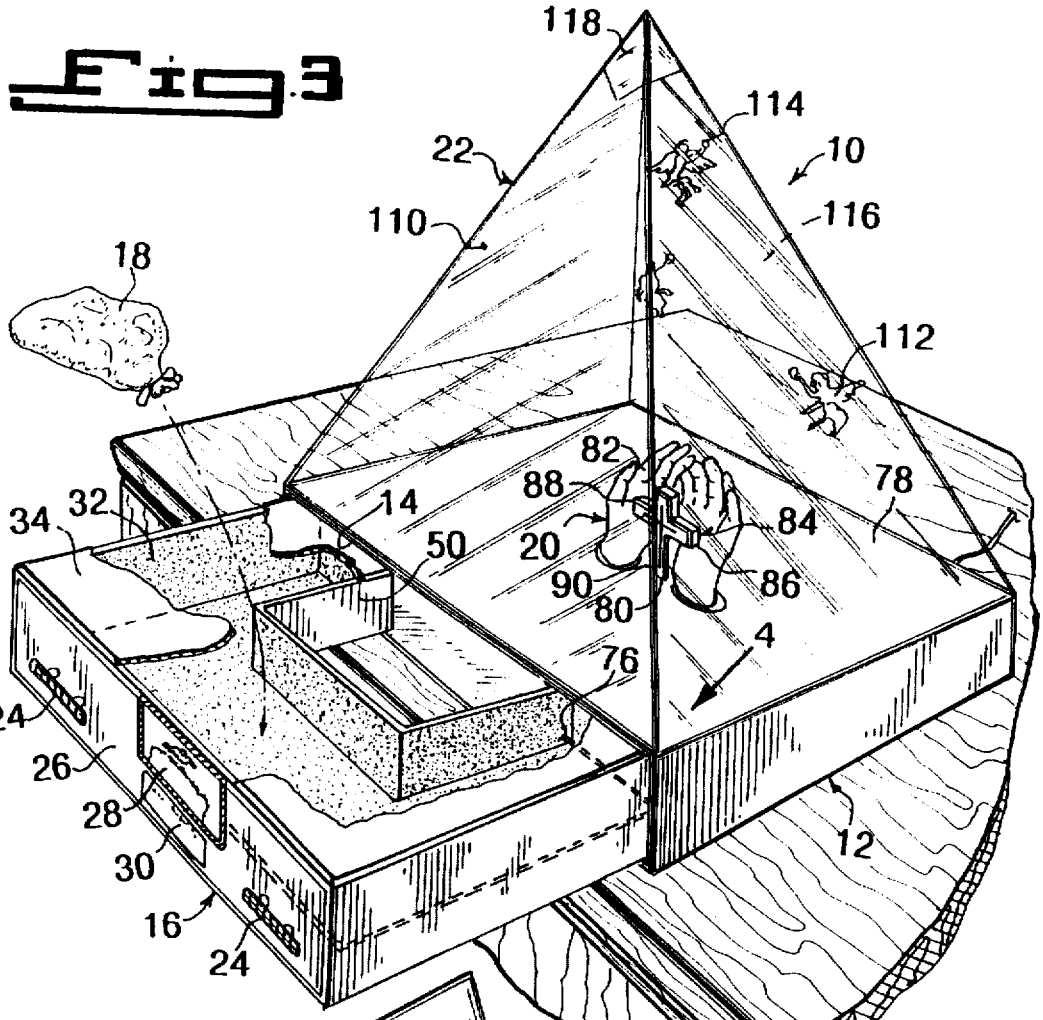

FIG. 3 is a side perspective view taken in the direction of arrow 3 in FIG. 1, showing the drawer partly pulled out from the base member and the cover broken away.

Figure 4:
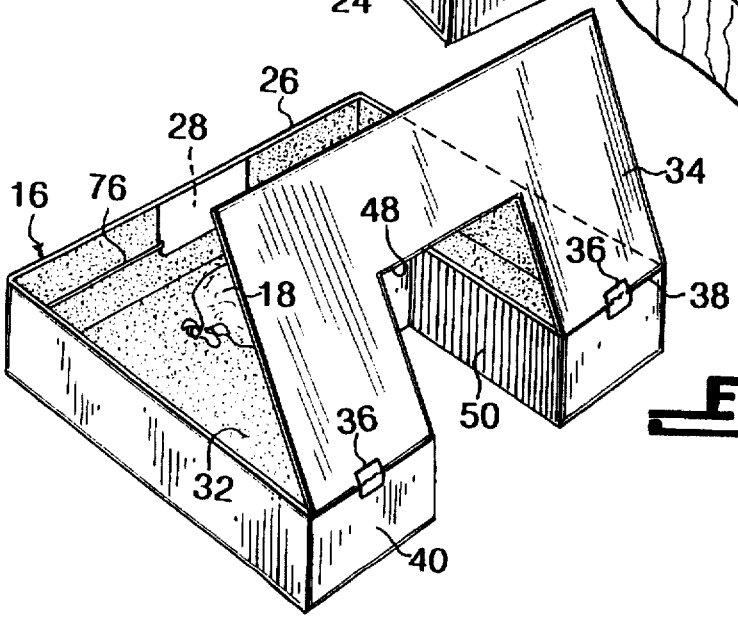

FIG. 4 is a rear perspective view of the drawer taken in the direction of arrow 4 in FIG. 3, showing the cover opened and the bag of cremation remains deposited therein.

Figure 5:
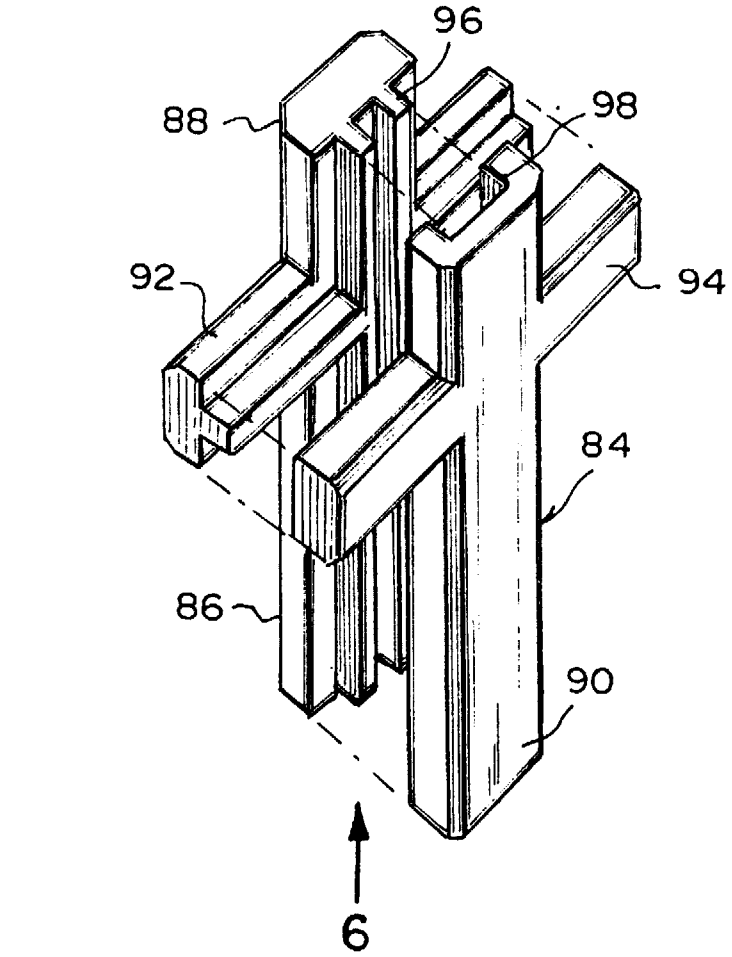

FIG. 5 is an exploded perspective view of a two segmented fiber optic cross which can hold some of the cremation remains when assembled together.

Figure 6:
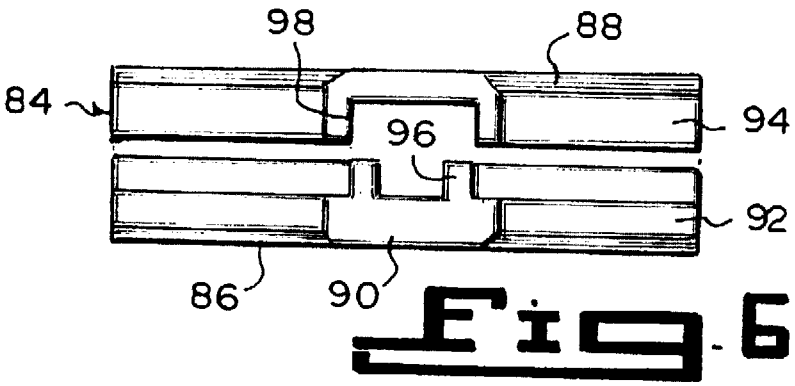

FIG. 6 is an exploded bottom view taken in the direction of arrow 6 in FIG. 5.

Figure 7:
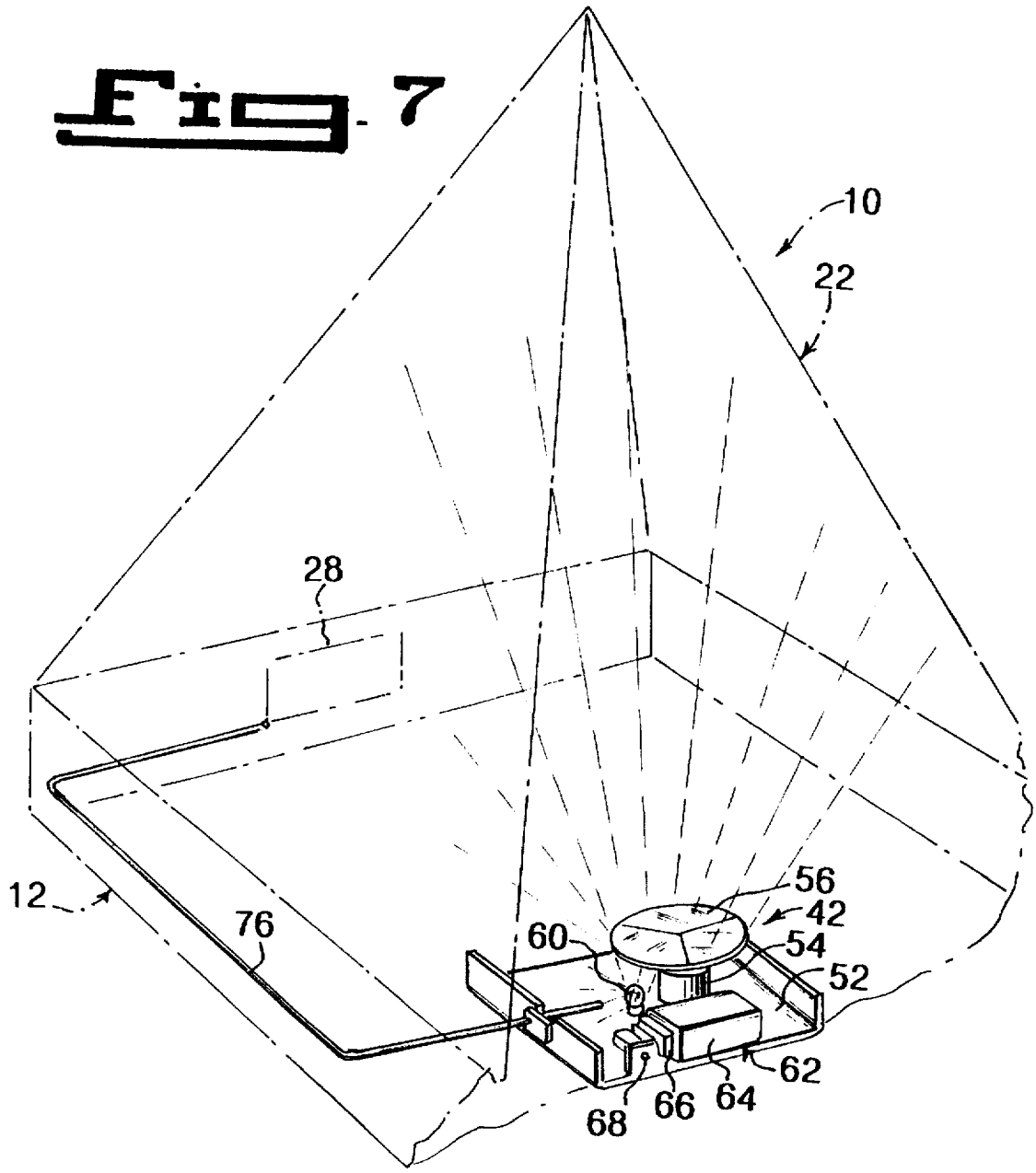

FIG. 7 is a rear perspective view of the instant invention in phantom and broken away, showing the fiber optic lighting system in greater detail.

Similar reference characters denote corresponding features consistently throughout the attached drawings.

DETAILED DESCRIPTION OF TEE PREFERRED EMBODIMENTS

Turning now descriptively to the drawings, in which similar reference characters denote similar elements throughout the several views, FIGS. 1 to 7 illustrate a display device 10 for retaining cremation remains comprising a hollow base member 12 having a front opening 14. A drawer 16 fits within the front opening 14 of the hollow base member 12, so that the drawer 16 can receive a bag 18 with the cremation remains. An ornament assembly 20 is on the hollow base member 12. A hollow transparent pyramid 22 fits over the ornament assembly 20 on the hollow base member 12.

The drawer 16 includes a pair of handles 24 spaced apart and attached to a front face 26 of the drawer 16, so that the handles 24 can be grasped by a hand to pull open the drawer 16. A prayer plaque 28 is mounted onto the front face 26 of the drawer 16 between the handles 24. A memory plaque 30 is mounted onto the front face 26 of the drawer 16 under the prayer plaque 28.

The drawer 16 further contains a felt liner 32 located therein. A cover 34 fits over the open top of the drawer 16. A pair of hinges 36 are between a rear edge 38 of the cover 34 and a back wall 40 of the drawer 16, so that the cover 34 can swing open and closed on the drawer 16.

A light source 42 is within the hollow base member 12, to illuminate the ornament assembly 20, the hollow transparent pyramid 22 and the prayer plaque 28. The hollow base member 12 has an aperture 44 in a top wall 46 thereof. The cover 34 has a rear cutout area 48 located under the aperture 44 in the top wall 46 of the hollow base member 12. The drawer 16 has a rear cutout area 50 located under the rear cutout area 48 of the cover 34, so that the light source 42 can be mounted in the hollow base member 12 under the aperture 44.

The light source 42, as best seen in FIGS. 2 and 7, includes a base plate 52. A motor 54 is mounted in an upright position upon the base plate 52. A color wheel 56 is affixed to a shaft 58 of the motor 54. A light bulb 60 is mounted in an upright position upon the base plate 52 and under a portion of the color wheel 56 adjacent the motor 54. A power supply 62 operates the motor 54, to turn the color wheel 56 and light up the light bulb 60.

The power supply 62 can be a battery 64 connected to contacts 66 on the base plate 52. The power supply 62 can also include an electrical jack 68 on the base plate 52. An electrical plug 70 will engage with the electrical jack 68. A power cord 72 has a first end connected to the electrical plug 70. An A/C-D/C adapter transformer plug 74 is connected to a second end of the power cord 72, so that the A/C-D/C adapter transformer plug can engage with a wall outlet (not shown). A fiber optic feed line 76 extends from the light bulb 60 to the prayer plaque 28 which is fiber optic, so that the fiber optic feed line 76 can illuminate the fiber optic prayer plaque 28.

The ornament assembly 20 consists of a blue tint LUCITE platform 78, having a central socket 80. A pair of LUCITE cupped hands 82 extend upwardly on the blue tint LUCITE platform 78 adjacent the central socket 80. A removable fiber optic ornament 84 is insertable into the central socket 80 of the blue tint LUCITE platform 78 in front of the pair of LUCITE cupped hands 82.

The fiber optic ornament 84, as shown in FIGS. 1, 2*a*, 3, 5 and 6, is a cross 86 having beveled edges 88 and a lower plug 90, which fits into the central socket 80 in the blue tint LUCITE platform 78. The cross 86, as shown in FIGS. 5 and 6, is longitudinally split into two segments 92, 94. One segment 92 has a male plug 96. The other segment 94 has a female socket 98, so that some of the cremation remains can be inserted between the two segments 92, 94 before being assembled together.

The fiber optic ornament 84 in FIGS. 2 and 2*b*, is a forked shaped picture frame 100, having a lower plug 102 which fits into the central socket 80 in the blue tint LUCITE platform 78. The forked shaped picture frame 100 includes a vertical track 104 to hold a protective transparent cover 106 and picture 108 of a deceased person therein.

The hollow transparent pyramid 22 is fabricated out of a fiber optic material 110, with a plurality of angels 112 holding balls 114 etched into a back surface 116 thereof. An illuminating pointed top tip 118 with ray lines 120 extends down therefrom.

LIST OF REFERENCE NUMBERS

10 display device
12 hollow base member of 10
14 front opening in 12
16 drawer of 10
18 bag with cremation remains in 16
20 ornament assembly of 10
22 hollow transparent pyramid of 10
24 handle on 26
26 front face of 16
28 prayer plaque on 26
30 memory plaque on 26
32 felt liner in 16
34 cover on 16
36 hinge between 38 and 40
38 rear edge of 34
40 back wall of 16
42 light source in 12
44 aperture in 46
46 top wall of 12
48 rear cutout area in 34
50 rear cutout area in 16
52 base plate of 42
54 motor on 52
56 color wheel on 58
58 shaft of 54
60 light bulb on 52
62 power supply for 54 and 60
64 battery for 62
66 contact on 52
68 electrical jack of 62
70 electrical plug of 62
72 power cord on 70
74 A/C-D/C adapter transformer plug on 70
76 fiber optic feed line of 42
78 blue tint LUCITE platform of 20
80 central socket in 78
82 LUCITE cupped hands of 20
84 fiber optic ornament of 20
86 cross for 84
88 beveled edge on 86
90 lower plug on 86
92 first segment of 86
94 second segment of 86
96 male plug on 92
98 female socket on 94
100 forked shaped picture frame for 84
102 lower plug on 100
104 vertical track in 100
106 protective transparent cover in 100
108 picture of deceased person in 100
110 fiber optic material for 22
112 angel in 116
114 ball in 116
116 back surface of 22
118 illuminating pointed top tip on 22
120 ray lines on 22

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A display device for retaining cremation remains comprising:

a) a hollow base member having a front opening;

b) a drawer fits within said front opening of said hollow base member, so that said drawer can receive a bag with the cremation remains;

c) an ornament assembly on said hollow base member; and d) a hollow transparent pyramid fits over said ornament assembly on said hollow base member.

2. A display device for retaining cremation remains as recited in claim 1, wherein said drawer includes:

a) a pair of handles spaced apart and attached to a front face of said drawer, so that said handles can be grasped by a hand to pull open said drawer;

b) a prayer plaque mounted onto said front face of said drawer between said handles; and c) a memory plaque mounted onto said front face of said drawer under said prayer plaque.

3. A display device for retaining cremation remains as recited in claim 2, wherein said drawer further includes:

a) a felt liner located therein;

b) a cover to fit over the open top of said drawer; and c) a pair of hinges between a rear edge of said cover and a back wall of said drawer, so that said cover can swing open and closed on said drawer.

4. A display device for retaining cremation remains as recited in claim 3, further including a light source within said hollow base member to illuminate said ornament assembly, said hollow transparent pyramid and said prayer plaque.

5. A display device for retaining cremation remains as recited in claim 4, further including:

a) said hollow base member having an aperture in a top wall thereof;

b) said cover having a rear cutout area located under said aperture in said top wall of said hollow base member; and c) said drawer having a rear cutout area located under said rear cutout area of said cover, so that said light source can be mounted in said hollow base member under said aperture.

6. A display device for retaining cremation remains as recited in claim 4, wherein said light source includes:

a) a base plate;

b) a motor mounted in an upright position upon said base plate;

c) a color wheel affixed to a shaft of said motor;

d) a light bulb mounted in an upright position upon said base plate and under a portion of said color wheel adjacent said motor; and e) a power supply to operate said motor to turn said color wheel and light up said light bulb.

7. A display device for retaining cremation remains as recited in claim 6, wherein said power supply is a battery connected to contacts on said base plate.

8. A display device for retaining cremation remains as recited in claim 6, wherein said power supply includes:

a) an electrical jack on said base plate;

b) an electrical plug to engage with said electrical jack;

c) a power cord having a first end connected to said electrical plug; and d) an A/C-D/C adapter transformer plug connected to a second end of said power cord, so that said A/C-D/C adapter transformer plug can engage with a wall outlet.

9. A display device for retaining cremation remains as recited in claim 6, wherein said light source further includes a fiber optic feed line extending from said light bulb to said prayer plaque which is fiber optic, so that said fiber optic feed line can illuminate said fiber optic prayer plaque.

10. A display device for retaining cremation remains as recited in claim 4, wherein said ornament assembly includes:

a) a blue tint LUCITE platform having a central socket;

b) a pair of LUCITE cupped hands extending upwardly on said blue tint LUCITE platform adjacent said central socket; and c) a removable fiber optic ornament insertable into said central socket of said blue tint LUCITE platform in front of said pair of LUCITE cupped hands.

11. A display device for retaining cremation remains as recited in claim 10, wherein said fiber optic ornament is a cross having beveled edges and a lower plug which fits into said central socket in said blue tint LUCITE platform.

12. A display device for retaining cremation remains as recited in claim 11, wherein said cross is longitudinally split into two segments in which one said segment has a male plug, while other said segment has a female socket, so that some of the cremation remains can be inserted between said two segments before being assembled together.

13. A display device for retaining cremation remains as recited in claim 10, wherein said fiber optic ornament is a forked shaped picture frame having a lower plug which fits into said central socket in said blue tint LUCITE platform, whereby said forked shaped picture frame includes a vertical track to hold a protective transparent cover and picture of a deceased person therein.

14. A display device for retaining cremation remains as recited in claim 1, wherein said hollow transparent pyramid is fabricated out of a fiber optic material with a plurality of angels holding balls etched into a back surface thereof and an illuminating pointed top tip with ray lines extending down therefrom.

15. A display device for retaining cremation remains comprising:

a) a hollow base member having a front opening;

b) a drawer fits within said front opening of said hollow base member, so that said drawer can receive a bag with the cremation remains, wherein said drawer includes a pair of handles spaced apart and attached to a front face of said drawer, so that said handles can be grasped by a hand to pull open said drawer, a prayer plaque mounted onto said front face of said drawer between said handles and a memory plaque mounted onto said front face of said drawer under said prayer plaque;

c) an ornament assembly on said hollow base member; and d) a hollow transparent pyramid fits over said ornament assembly on said hollow base member.

16. A display device for retaining cremation remains as recited in claim 15, wherein said drawer further includes:

a) a felt liner located therein;

b) a cover to fit over the open top of said drawer; and c) a pair of hinges between a rear edge of said cover and a back wall of said drawer, so that said cover can swing open and closed on said drawer.

17. A display device for retaining cremation remains as recited in claim 16, further including a light source within said hollow base member to illuminate said ornament assembly, said hollow transparent pyramid and said prayer plaque.

18. A display device for retaining cremation remains as recited in claim 17, further including:

a) said hollow base member having an aperture in a top wall thereof;

b) said cover having a rear cutout area located under said aperture in said top wall of said hollow base member; and c) said drawer having a rear cutout area located under said rear cutout area of said cover, so that said light source can be mounted in said hollow base member under said aperture.

19. A display device for retaining cremation remains as recited in claim 18, wherein said light source includes:

a) a base plate;

b) a motor mounted in an upright position upon said base plate;

c) a color wheel affixed to a shaft of said motor;

d) a light bulb mounted in an upright position upon said base plate and under a portion of said color wheel adjacent said motor; and e) a power supply to operate said motor to turn said color wheel and light up said light bulb.

20. A display device for retaining cremation remains as recited in claim 19, wherein said power supply is a battery connected to contacts on said base plate.

21. A display device for retaining cremation remains as recited in claim 20, wherein said power supply includes:

a) an electrical jack on said base plate;

b) an electrical plug to engage with said electrical jack;

c) a power cord having a first end connected to said electrical plug; and d) an A/C-D/C adapter transformer plug connected to a second end of said power cord, so that said A/C-D/C adapter transformer plug can engage with a wall outlet.

22. A display device for retaining cremation remains as recited in claim 21, wherein said light source further includes a fiber optic feed line extending from said light bulb to said prayer plaque which is fiber optic, so that said fiber optic feed line can illuminate said fiber optic prayer plaque.

23. A display device for retaining cremation remains as recited in claim 22, wherein said ornament assembly includes:

a) a blue tint LUCITE platform having a central socket;

b) a pair of LUCITE cupped hands extending upwardly on said blue tint LUCITE platform adjacent said central socket; and c) a removable fiber optic ornament insertable into said central socket of said blue tint LUCITE platform in front of said pair of LUCITE cupped hands.

24. A display device for retaining cremation remains as recited in claim 23, wherein said fiber optic ornament is a cross having beveled edges and a lower plug which fits into said central socket in said blue tint LUCITE platform.

25. A display device for retaining cremation remains as recited in claim 24, wherein said cross is longitudinally split into two segments in which one said segment has a male plug, while other said segment has a female socket, so that some of the cremation remains can be inserted between said two segments before being assembled together.

26. A display device for retaining cremation remains as recited in claim 23, wherein said fiber optic ornament is a forked shaped picture frame having a lower plug which fits into said central socket in said blue tint LUCITE platform, whereby said forked shaped picture frame includes a vertical track to hold a protective transparent cover and picture of a deceased person therein.

27. A display device for retaining cremation remains as recited in claim 23, wherein said hollow transparent pyramid is fabricated out of a fiber optic material with a plurality of angels holding balls etched into a back surface thereof and an illuminating pointed top tip with ray lines extending down therefrom.

* * * * *